US008608273B2

(12) United States Patent
Ernst et al.

(10) Patent No.: US 8,608,273 B2
(45) Date of Patent: Dec. 17, 2013

(54) PRINT DATA COMPENSATION FOR VARIATIONS IN PAPER POSITION WITHIN A PRINTING SYSTEM

(75) Inventors: Larry M. Ernst, Longmont, CO (US); Michael J. Holley, Broomfield, CO (US); Mikel J. Stanich, Longmont, CO (US); John C. Wilson, Longmont, CO (US)

(73) Assignee: Ricoh Production Print Solutions, Boulder, CO (US)

( * ) Notice: Subject to any disclaimer, the term of this patent is extended or adjusted under 35 U.S.C. 154(b) by 398 days.

(21) Appl. No.: 13/038,880

(22) Filed: Mar. 2, 2011

(65) Prior Publication Data

US 2012/0223996 A1 Sep. 6, 2012

(51) Int. Cl.
*B41J 29/38* (2006.01)

(52) U.S. Cl.
USPC ..... 347/16

(58) Field of Classification Search
CPC ..... B41J 2/2132; B41J 2/155
USPC ..... 347/12, 14, 16, 19, 101, 104
See application file for complete search history.

(56) References Cited

U.S. PATENT DOCUMENTS

| | | | | |
|---|---|---|---|---|
| 4,538,905 | A | 9/1985 | Griego et al. | |
| 5,093,674 | A | 3/1992 | Storlie | |
| 6,052,552 | A | 4/2000 | Ohsumi et al. | |
| 6,429,945 | B1 | 8/2002 | Loffler | |
| 7,456,995 | B2 | 11/2008 | Stephens | |
| 7,990,563 | B2 * | 8/2011 | Uno | 358/1.17 |
| 8,136,903 | B2 * | 3/2012 | Kunihiro | 347/12 |
| 8,308,261 | B2 * | 11/2012 | Aruga | 347/13 |

OTHER PUBLICATIONS

Print Wizard: Print Processing Engine, LPD, DLL, OCX. (2008) Technical Destiption Version 3.2, p. 1-4. (See PWML Features Section).

* cited by examiner

*Primary Examiner* — An Do
(74) *Attorney, Agent, or Firm* — Duft Bornsen & Fettig, LLP

(57) ABSTRACT

Methods and systems herein provide for print data compensation for a print head based on a lateral offset of a media relative to the print head. In one embodiment, a print controller of a printer identifies an edge of a media that is parallel to a direction of travel of the media, and determines a lateral offset between the edge of the media and a print head of the printer. The print controller then modifies data for the print head based on the lateral offset to compensate for a lateral motion of the media relative to the print head.

14 Claims, 9 Drawing Sheets

FIG. 9

902

| | |
|---|---|
| A | B |
| C | D |

FIG. 10

1004

1002

| | | | | | | |
|---|---|---|---|---|---|---|
| A | A | A | B | B | B | |
| A | A | A | B | B | B | |
| A | A | A | B | B | B | |
| C | C | C | D | D | D | |
| C | C | C | D | D | D | |
| C | C | C | D | D | D | |

FIG. 11

1004

1102

| | | | | | | |
|---|---|---|---|---|---|---|
| | A | A | A | B | B | B |
| | A | A | A | B | B | B |
| | A | A | A | B | B | B |
| | C | C | A | D | D | B |
| | C | C | A | D | D | B |
| | C | C | A | D | D | B |

FIG. 12

1202

| | |
|---|---|
| A` | B` |
| C` | D` |

PRINT DATA COMPENSATION FOR VARIATIONS IN PAPER POSITION WITHIN A PRINTING SYSTEM

FIELD OF THE INVENTION

The invention relates to the field of printing systems, and in particular, to modifying print data for a print head to compensate for the lateral motion of a print media relative to the print head.

BACKGROUND

Production printing systems typically use a number of ink jet heads for imprinting onto continuous form media (e.g., large rolls of paper). For example, in a CMYK (Cyan, Magenta, Yellow, and Key (e.g., black) ink jet printer, 4 print heads may be used; one for each color. An ink jet head is an array of nozzles that eject ink drops at high speed onto a media to generate a printed output. The nozzles are fabricated in the print head to represent a pel or pixel of the output. For example, in a 1200 DPI (dots per inch) print head that is 20 inches wide, 24,000 nozzles are used to generate a line of pels on the media, also known as a "scan line". A data buffer for the print head stores pel data for each nozzle of the print head. Pel data is typically multiple bits per pel that are used to vary the ink output of a nozzle over a range. In the 1200 DPI print head example, the buffer may store 24,000 pels of data, one pel per nozzle. As the media advances, the print head ejects ink based on the pel data in the buffer to render each line in the printed output. As the media moves, new pel data for the print head is loaded into the buffer, and pel data is printed by the print head. This process continues to generate the output.

In production printing systems, controlling the lateral movement of the media with respect to a print head is desired to ensure that print margins are maintained and that images appear straight and centered within the media. Due to the mechanical complexity in routing the paper through the printing system, some type of lateral movement of the media with respect to the print head is always present. This movement is oscillatory in nature and may be as much as +/−1 mm with a period of a few meters. The movement of the media poses a problem, as it alters the print margins and the location of printed regions with respect to the edges of the media.

It thus remains a problem to compensate for the lateral motion of the media with respect to the print head in order to more accurately generate printed documents.

SUMMARY

Embodiments described herein provide print data compensation for a print head based on a lateral offset of a media relative to the print head. Data for the print head is modified based on a lateral offset that is detected between the print head and the edge of the media to compensate for the lateral offset. This allows the printed portion of the media to be consistently registered with the edge of the media, regardless of how the media may move laterally with respect to the print head.

In one embodiment, a print controller of a printer is disclosed. The print controller includes a detection system and a data compensator. The detection system identifies an edge of a media that is parallel to a direction of travel of the media, and determines a lateral offset between the edge of the media and a print head of the printer. The data compensator modifies data for the print head based on the lateral offset to compensate for a lateral motion of the media relative to the print head.

In another embodiment, the print head is an ink jet print head and the pel data is stored in a buffer for the ink jet print head. In this embodiment, pel positions in the buffer correspond with nozzle positions of the print head. After determining the lateral offset between the edge of the media and the print head, the data compensator shifts the pel data in the buffer for the print head +/− some number of pel positions based on the lateral offset to compensate for the lateral motion of the media. As the pel positions in the buffer correspond with nozzle positions of the print head, shifting the pel data in the buffer results in a shift in the nozzles that are used to print the pel data onto the media.

In another embodiment, the data compensator determines a fractional number of pels to shift the data based on the lateral offset. In this embodiment, the data for the print head is up-scaled to a higher resolution based on the fractional number of pels and a pel resolution of the print head. The higher resolution pel data is shifted based on the fractional number of pels, and is downscaled to the pel resolution of the print head. This allows for the compensation of the lateral motion of the media in sub-pel increments.

Other exemplary embodiments may be described below.

DESCRIPTION OF THE DRAWINGS

Some embodiments of the present invention are now described, by way of example only, and with reference to the accompanying drawings. The same reference number represents the same element or the same type of element on all drawings.

FIGS. 9-12 are block diagrams illustrating examples of pel data at various steps of the method of FIG. 8.

DESCRIPTION OF THE EMBODIMENTS

The figures and the following description illustrate specific exemplary embodiments of the invention. It will thus be appreciated that those skilled in the art will be able to devise various arrangements that, although not explicitly described or shown herein, embody the principles of the invention and are included within the scope of the invention. Furthermore, any examples described herein are intended to aid in understanding the principles of the invention, and are to be construed as being without limitation to such specifically recited examples and conditions. As a result, the invention is not limited to the specific embodiments or examples described below, but by the claims and their equivalents.

Figure 1:
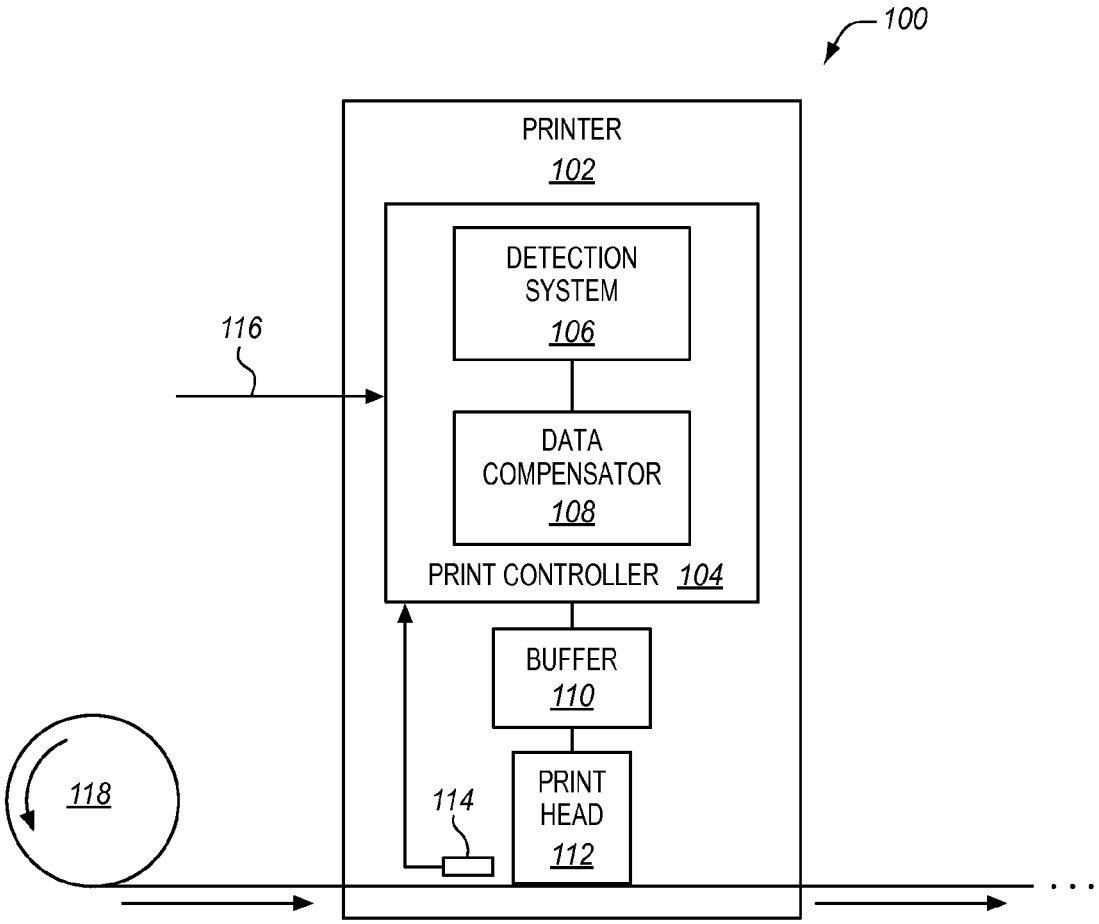
FIG. 1 is a block diagram of a printing system in an exemplary embodiment.

FIG. 1 is a block diagram of a printing system 100 in an exemplary embodiment. System 100 includes a printer 102 and a continuous form media 118 for imprinting by printer 102. Printer 102 includes a print controller 104, a print buffer 110, and a print head 112. Printer 102 may also include a sensor 114 proximate to print head 112 for detecting an edge of media 118. In printer 102, controller 104 receives print data 116 for imprinting onto media 118. Print controller 102 may perform a number of data processing operations on print data 116, such as generating raster bitmaps based on print data 116 before the bitmap data is transmitted to buffer 110. Print head 112 reads the bitmap or pel data from buffer 110, and imprints media 118 based on the data.

Figure 2:
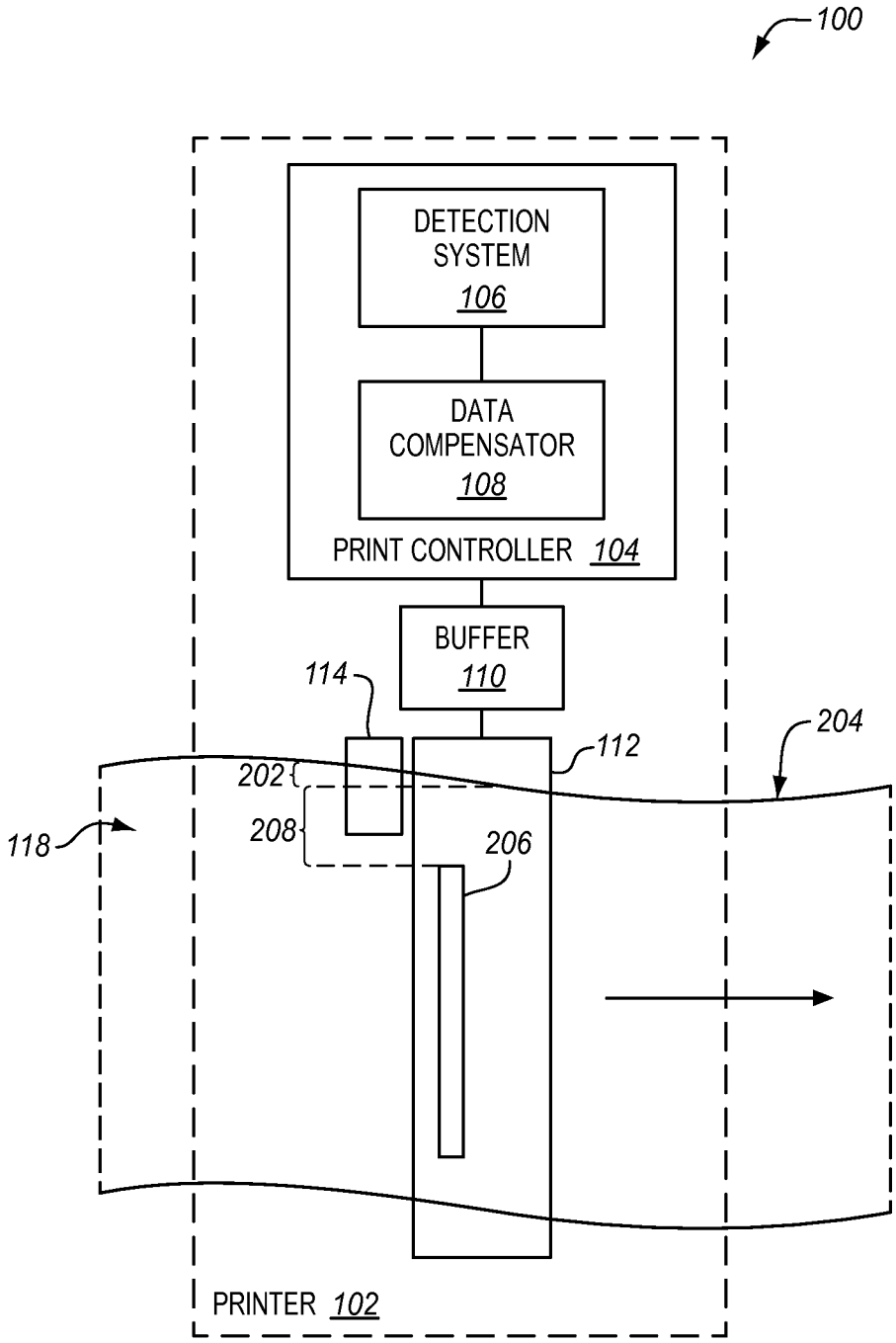
FIG. 2 is another block diagram of the printing system of FIG. 1 in an exemplary embodiment.

In this embodiment, routing media 118 proximate to print head 112 in system 100 may result in a lateral movement of media 118 with respect to print head 112. This may be due to the routing and/or mechanical registration of media 118 relative to print head 112 being imprecise. For example, as media 118 travels past print head 112 in the direction indicated by the arrow in FIG. 1, media 118 may wobble laterally with respect to print head 112. This wobble in media 118 introduces a time varying offset between media 118 and print head 112, which alters the margins between the edges of media 118 and the printed area of media 118, generating an undesirable printed output from printer 102. In this embodiment, print controller 104 compensates for the offset by modifying data for print head 112. The time varying offset along an edge of media 118 is more clearly illustrated in FIG. 2. FIG. 2 is another block diagram of printing system 100 in an exemplary embodiment. FIG. 2 illustrates how media 118 travels proximate to print head 112 oriented along a top view. As seen in FIG. 2, media 118 wobbles as media 118 travels in the direction indicated by the arrow. This wobble introduces an offset 202 along an edge 204 of media 118, which is detected by sensor 114. Also note that offset 202 changes over time as media 118 travels in the direction indicated by the arrow. An example of how print controller 104 may operate will be discussed in more detail with regard to FIG. 3.

Figure 3:
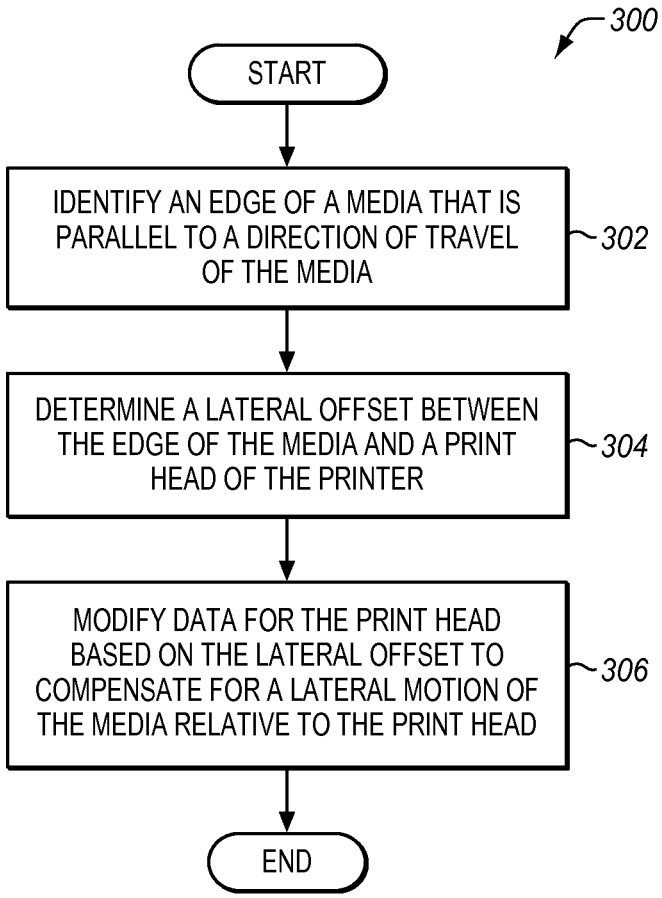
FIG. 3 is flow chart illustrating a method of compensating print data for a lateral motion of a media relative to the print head in an exemplary embodiment.

FIG. 3 is flow chart illustrating a method 300 of compensating print data for a lateral motion of a media relative to the print head in an exemplary embodiment. The steps of method 300 will be described with respect to system 100 of FIGS. 1-2, although one skilled in the art will understand that method 300 may be performed by other systems not shown. The steps of the methods described herein are not all inclusive and may include other steps not shown. The steps may also be performed in an alternative order.

In step 302, detection system 106 identifies edge 204 that is parallel to a direction of travel of media 118. Detection system 106 receives data from sensor 114 to identify edge 204. Although sensor 114 is illustrated where media 118 enters an area around print head 112, sensor 114 may also be located where media 118 exits the area around print head 112 after printing. Further, multiple sensors may be located around print head 112 to identify edge 204.

In step 304, detection system 106 determines a lateral offset 202 between edge 204 of media 118 and print head 112. When determining offset 202, detection system 106 may use information from sensor 114 identifying edge 204 along with a spatial relationship between sensor 114 and print head 112. In this embodiment, sensor 114 is positioned relative to an active region 206 of print head 112 for printing onto media 118. Active region 206 includes an array of nozzles or some other type of printing technology for imprinting pel data onto media 118. More specifically, a center line of sensor 114 is offset from active region 206 by a spacing 208. This allows detection system 106 to calculate offset 202 relative to known features of print head 112, such as active region 206 of print head 112. Although FIG. 2 illustrates a specific spatial relationship between sensor 114 and print head 112, one skilled in the art will understand that other spatial relationships may exist as a matter of design choice.

In step 306, data compensator 108 modifies data for print head 112 based on offset 202 calculated in step 304. Modifying the data compensates for a lateral motion of media 118 relative to print head 112 as media 118 travels in the direction indicated by the arrow. The modified data for print head 112 may then be printed onto media 118. Modifying the data for print head 112 allows printing onto media 118 to be more accurately registered with edge 204. This improves the printing process. The particular details about how the data may be modified will be discussed with respect to FIGS. 4-12.

Figure 4:
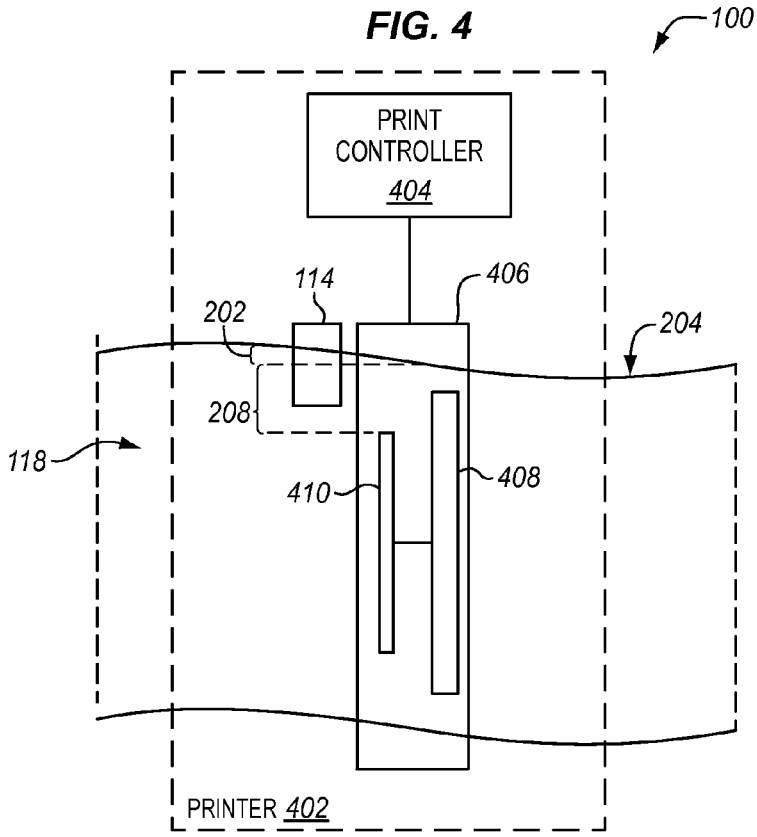
FIG. 4 is a block diagram of a printing system in another exemplary embodiment.

FIG. 4 is a block diagram of printing system 100 in another exemplary embodiment. FIG. 4 illustrates a printer 402 for imprinting on media 118. Printer 402 includes a print controller 404, an ink jet print head 406, and sensor 114. Print head 406 includes an active area 410 comprising an array of ink nozzles. A buffer 408 stores pel data for the array of nozzles.

Figure 5:
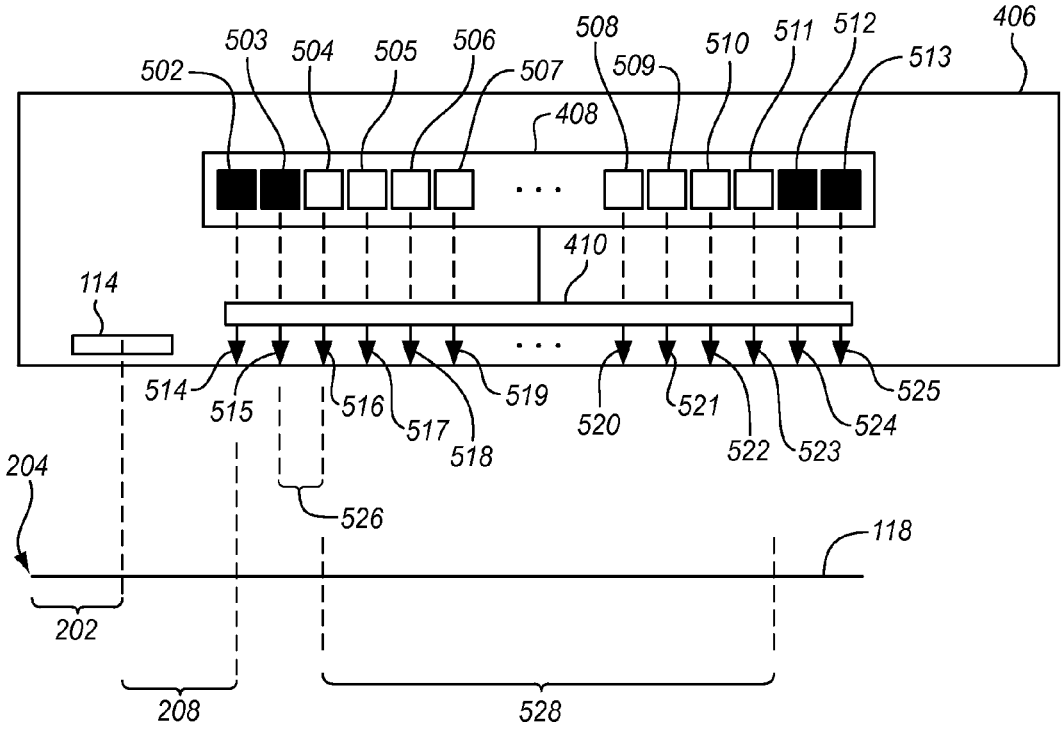
FIG. 5 is a block diagram illustrating an exploded view of a print head in an exemplary embodiment.

FIG. 5 is a block diagram illustrating an exploded view of print head 406 in an exemplary embodiment. In this embodiment, buffer 408 includes pel locations 502-513 for storing pel data. Each of pel location 502-513 corresponds with one of nozzles 514-525. Thus, data in pel location 507 corresponds with nozzle 519, and data in pel location 508 corresponds with nozzle 520. In this embodiment, pel locations 502-503 and 512-513 are pre-loaded with zero values. A spacing 526 illustrates a pel pitch or dot pitch of print head 406. Spacing 526 is a distance between nozzles 514-525. For example, in a 1200 DPI print head, spacing 526 is $1/1200$th of an inch. Also, a printing region 528 is illustrated that corresponds to a location on media 118 that will be imprinted by print head 406 based on the pel data loaded into buffer 408. For optimal human visual performance, the smallest lateral shift step size would typically be smaller than the human visual perceptual threshold. The smallest lateral shift then provides a possible minimum head spacing 526 for print head 406.

Figure 6:
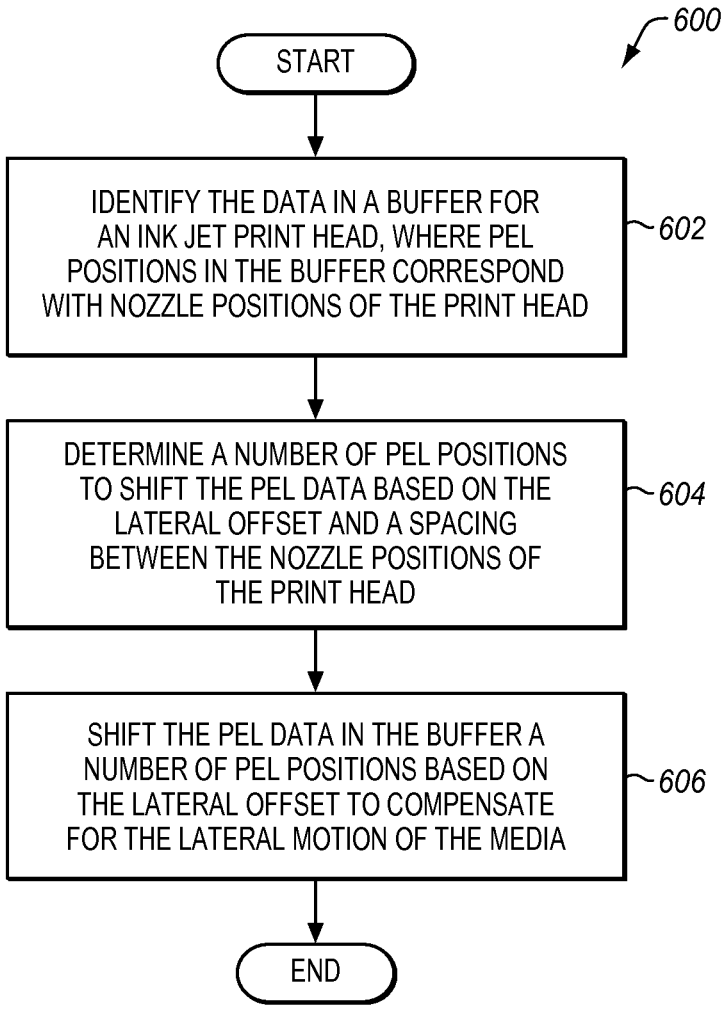
FIG. 6 is a flow chart illustrating a method of modifying pel data for the print head using pel shifts to compensate for a lateral motion of a media relative to a print head in an exemplary embodiment.

FIG. 6 is a flow chart illustrating a method 600 of modifying pel data for the print head using pel shifts to compensate for a lateral motion of a media relative to a print head in an exemplary embodiment. The steps of method 600 will be described with respect to system 100 of FIGS. 4-5, although one skilled in the art will understand that method 600 may be performed by other systems not shown.

In step 602, print controller 404 identifies pel data in buffer 408 for imprinting onto media 118 by print head 406. In this embodiment, pel data is stored in pel locations 504-511. When in operation, print head 406 translates pel data to ink droplets using nozzles 514-525. Generally, buffer 408 is periodically loaded with pel data and nozzles 514-525 are activated. When activated, nozzles 514-525 eject droplets of ink based on the pel data stored in the corresponding pel locations 502-513. Region 528 corresponds with non-zero pel data stored in buffer 408. As pel locations 502-503 and 512-513 are pre-loaded with zero pel values, nozzles 514-515 and 524-525 will not eject ink droplets when print head 406 is activated.

In step 604, print controller 404 determines a number of pel positions to shift the pel data in buffer 408 based on offset 202 and spacing 526. For instance, if print controller 404 determines that offset 202 is 2/1200th of an inch, then print controller may determine that the number of pel positions to shift the pel data is 2 (i.e., offset is 2/1200th of an inch, and spacing 526 between nozzles is 1/1200th of an inch).

Figure 7:
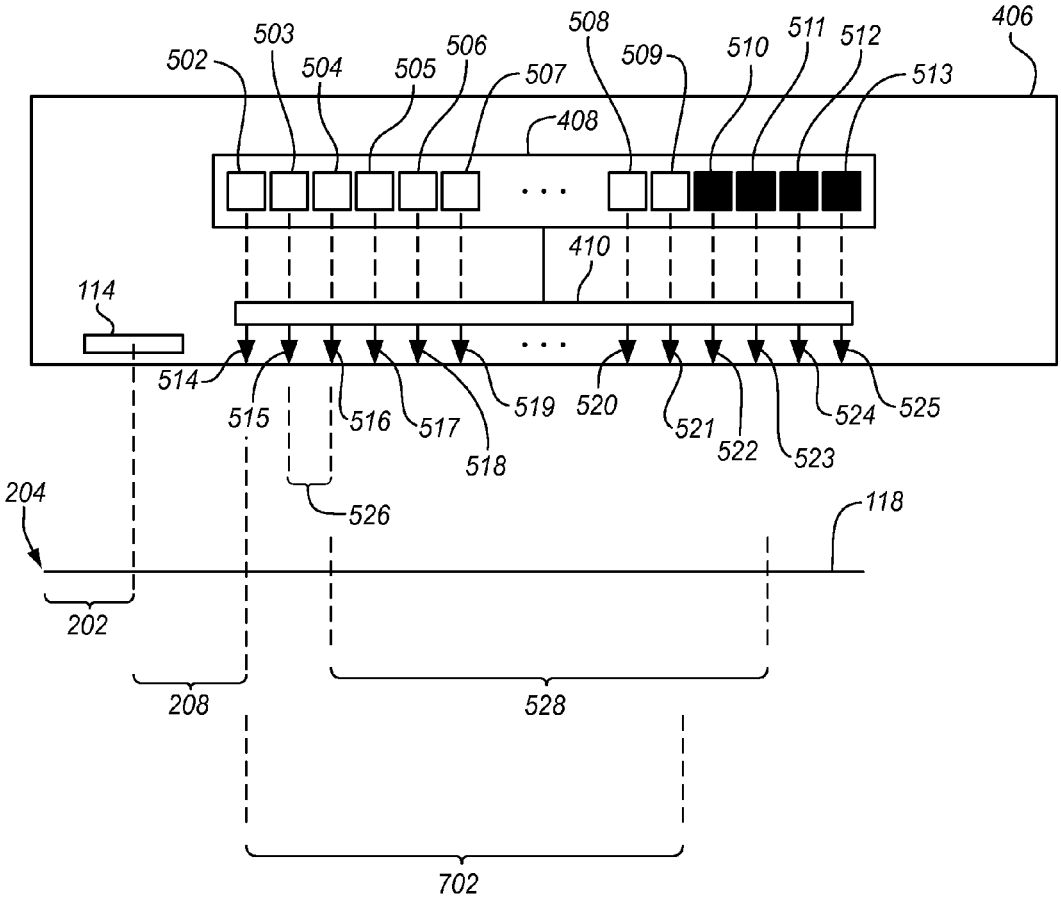
FIG. 7 is a block diagram illustrating an exploded view of a print head after pels are shifted in a buffer based on an offset in an exemplary embodiment.

In step 606, print controller 404 shifts the pel data in buffer 408 the number of pel positions determined in step 604. In the example, the number of pel positions to shift is 2. FIG. 7 is a block diagram illustrating an exploded view of print head 406 after pels are shifted in buffer 408 based on offset 202 in an exemplary embodiment. In FIG. 7, a printing area 702 has shifted to the left 2 pel positions. Pel positions 510-513 are now zero and therefore, nozzles 522-525 do not print. Also, pel data previously stored in pel locations 504-511 are shifted to pel locations 502-509. This shifts the region on media 118 that will be printed when print head 406 is activated (e.g., from printing region 528 to printing region 702), which advantageously compensates for the lateral motion of media 118 relative to the print head. Shifting the pel data within buffer 408 more accurately maintains the margins on media 118 between the printed area and edge 204.

Although FIGS. 5 and 7 illustrate a specific configuration of pel locations, nozzles, and one example of how pel data may be shifted in buffer 408 to compensate for the lateral motion of media 118, one skilled in the art will understand that any number of pel locations, nozzles, and data shifts may occur. Further, one skilled in the art will understand that both positive and negative pel shifts may occur, and therefore, pel data may be shifted both to the left and to the right in FIG. 7. Also, although only one print head 406 is shown, additional print heads may be included and offset from print head 406 by a fractional pel position. For example, an additional print head may be offset from print head 406 by ½ of a pel position. When pel data is shifted between buffers for the offset print heads, ½ pel position shifts are possible. One skilled in the art will understand that adding additional print heads at fractional pel positions allows for ⅓, ¼, ⅕ pel shifts using a combination of print heads, each offset from each other.

In some embodiments, it may be desirable to shift pel data in buffer 408 by a fractional amount that does not correspond to the pel resolution of print head 406. For example, while one print head may allow whole pel shifts, fractional pel shifts may be desired without adding additional offset print heads.

Figure 8:
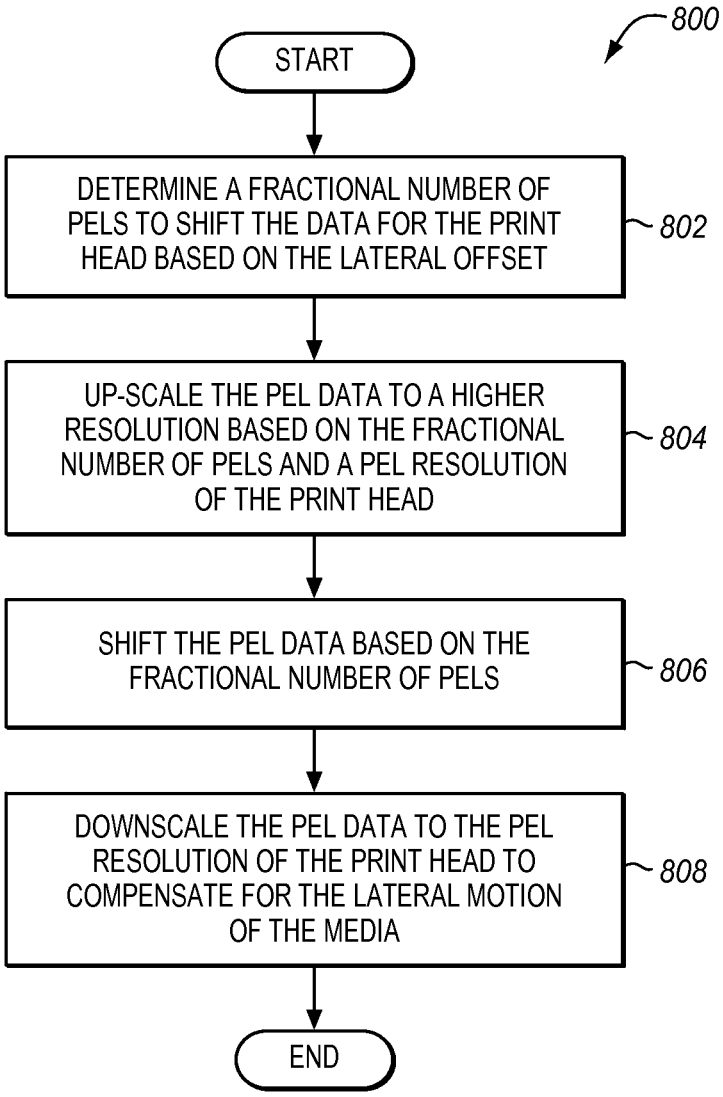
FIG. 8 is a flow chart illustrating a method of generating fractional pel shifts for a print head in an exemplary embodiment.

FIG. 8 is a flow chart illustrating a method 800 of generating fractional pel shifts for a print head in an exemplary embodiment. The steps of method 800 will be described with respect to system 100 of FIG. 4-5, although one skilled in the art will understand that method 800 may be performed by other systems not shown.

In step 802, print controller 404 determines a fractional number of pels to shift the pel data based on offset 202. In this embodiment, offset 202 is a fractional pel offset. In other words, the pel shift is not 1, 2, 3 . . . etc., pel shifts, but is instead is some fraction of a pel, such as ½ of a pel. Consider the example whereby the fractional number of pels to shift is ⅓.

In step 804, print controller 404 up-scales the pel data to a higher resolution based on the fractional number of pels determined in step 802 and a pel resolution of the print head. FIGS. 9-12 are block diagrams illustrating examples of pel data at various steps of method 800. FIG. 9 is a block diagram of input pel data 902. Input pel data 902 is shown as A, B, C, and D pels in a 2×2 array. FIG. 10 is a block diagram illustrating scaled pel data 1002 after performing step 804. Scaled pel data 1002 is shown as a 6×6 array of pels. More particularly, each pel A, B, C, and D now comprise a 3×3 array of pels. When performing step 804 to up-scale input pel data 902 to scaled pel data 1002, print controller 404 may use pel replication or some other type of pel data scaling. Pel replication is shown as the result of performing step 804 in FIG. 10 for the purpose of this discussion. A block of pels 1004 illustrates one pel of input pel data 902 as scaled. In the example, pels A, B, C, and D are replicated as 3×3 pel matrices from the original matrix data of pels A, B, C, and D shown in input pel data 902. This corresponds to a scaling factor of 3, which is the inverse of the example shift of ⅓ of a pel. If input pel data 902 were encoded at a resolution of 1200 DPI, then the resolution of scaled pel data 1002 after step 804 would be 3×1200 or 3600 DPI.

In step 806, print controller shifts the pel data the fractional number of pels determined in step 802. Shifted pel data 1102 illustrates an example of shifting the scaled pel data 1002 shown in FIG. 10.

In step 808, print controller 404 downscales shifted pel data 1102 to the resolution of print head 406 to compensate for the lateral motion of media 118. Output pel data 1202 is the result of performing step 808 in the example. To downscale the pel data, print controller 404 may average the pels located in block 1004 after shifting the pels, as shown in FIG. 11. For instance, print controller 404 may average pels located in block 1004 to generate output pel data 1202 shown in FIG. 12. In the example, downscaling pels within block 1004 results in pel A'. Print controller 404 may also use the average of pels in block 1004 to generate contone data. After performing step 808, print controller 404 may send output pel data 1202 to print head 406 for printing. In the example, each row of pels shown in FIG. 12 would be part of a scan line. Further, each row of pels in FIG. 12 (e.g., A', B') represents pel data for a particular nozzle in print head 406 along a scan line. As output pel data 1202 includes pel data shifted by a fractional amount (e.g., ⅓ in the example, where A→A'), this allows for a compensation of the lateral motion of media 118 relative to print head 406, even though printer 402 may not include offset print heads for fractional pel shifting.

Figure 13:
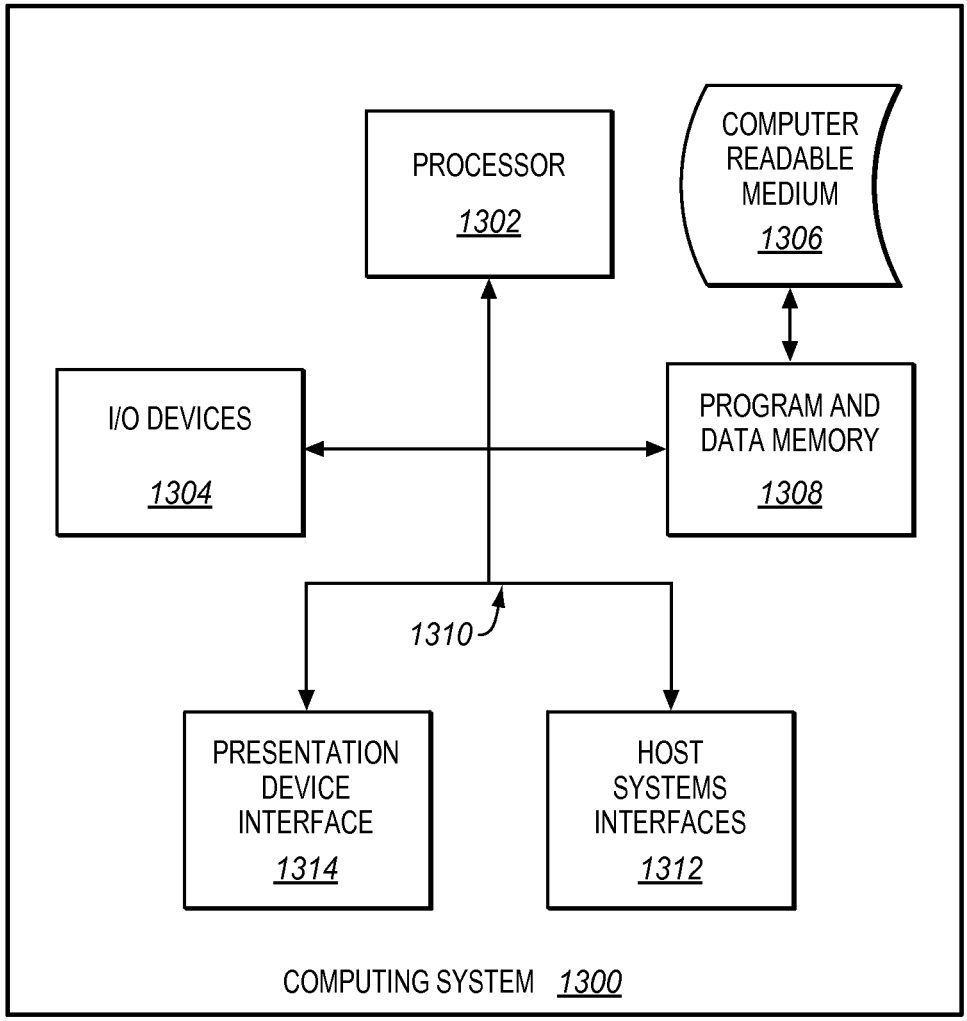
FIG. 13 illustrates a computing system in which a computer readable medium may provide instructions for performing the methods of FIGS. 3, 6, and 8 in an exemplary embodiment.

The invention can take the form of an entirely hardware embodiment, an entirely software embodiment or an embodiment containing both hardware and software elements. In one embodiment, the invention is implemented in software, which includes but is not limited to firmware, resident software, microcode, etc. FIG. 13 illustrates a computing system 1300 in which a computer readable medium 1306 may provide instructions for performing methods 300, 600, and 800 in an exemplary embodiment.

Furthermore, the invention can take the form of a computer program product accessible from a computer-usable or computer-readable medium 1306 providing program code for use by or in connection with a computer or any instruction execution system. For the purposes of this description, a computer-usable or computer readable medium 1306 can be any apparatus that can contain, store, communicate, propagate, or transport the program for use by or in connection with the instruction execution system, apparatus, or device.

The medium 1306 can be an electronic, magnetic, optical, electromagnetic, infrared, or semiconductor system (or apparatus or device) or a propagation medium. Examples of a computer-readable medium 1306 include a semiconductor or solid state memory, magnetic tape, a removable computer diskette, a random access memory (RAM), a read-only memory (ROM), a rigid magnetic disk and an optical disk. Current examples of optical disks include compact disk-read only memory (CD-ROM), compact disk-read/write (CD-R/W) and DVD.

A data processing system suitable for storing and/or executing program code will include one or more processors 1302 coupled directly or indirectly to memory 1308 through a system bus 1310. The memory 1308 can include local memory employed during actual execution of the program code, bulk storage, and cache memories which provide temporary storage of at least some program code in order to reduce the number of times code is retrieved from bulk storage during execution.

Input/output or I/O devices 1304 (including but not limited to keyboards, displays, pointing devices, etc.) can be coupled to the system either directly or through intervening I/O controllers.

Network adapters may also be coupled to the system to enable the data processing system to become coupled to other data processing systems, such a through host systems interfaces 1312, or remote printers or storage devices through intervening private or public networks. Modems, cable modem and Ethernet cards are just a few of the currently available types of network adapters.

Although specific embodiments were described herein, the scope of the invention is not limited to those specific embodiments. The scope of the invention is defined by the following claims and any equivalents thereof.

We claim:

1. A print controller of a printer, the print controller comprising:

a detection system operable to identify an edge of a media that is parallel to a direction of travel of the media, and to determine a lateral offset between the edge of the media and a print head of the printer; and a data compensator operable to identify pel data in a buffer for an ink jet print head, wherein pel positions in the buffer correspond with nozzle positions of the ink jet print head;

the data compensator further operable to shift the pel data in the buffer a number of (n) pel positions based on the lateral offset to compensate for a lateral motion of the media relative to the print head.

2. The print controller of claim 1 wherein the ink jet print head is a first ink jet print head, wherein the buffer is a first buffer, and wherein:

the data compensator is further operable to identify pel positions in a second buffer for a second ink jet print head, wherein pel position in the second buffer correspond with nozzle positions in the second ink jet print head, and wherein the second ink jet print head has nozzle positions that are offset from the first ink jet print head by a fraction of a pel position, and the data compensator is further operable to shift the pel data between the first buffer and the second buffer based on the lateral offset to compensate for a fraction of a pel position shift in the lateral motion of the media.

3. The print controller of claim 1 wherein:

the data compensator is further operable to determine the number of (n) pel positions to shift the pel data based on the lateral offset and a spacing between the nozzle positions of the ink jet print head.

4. The print controller of claim 1 wherein:

the data compensator is further operable to identify a scan line of pel data in the buffer, and to shift the scan line the number of (n) pel positions to maintain a margin between the edge of the media and a printed area on the media.

5. A method operable on a print controller of a printer, the method comprising:

identifying an edge of a media that is parallel to a direction of travel of the media;

determining a lateral offset between the edge of the media and a print head of the printer; and modifying data for the print head based on the lateral offset to compensate for a lateral motion of the media relative to the print head by:

identifying pel data in a buffer for an ink jet print head, wherein pel positions in the buffer correspond with nozzle positions of the ink jet print head; and shifting the pel data in the buffer a number of (n) pel positions based on the lateral offset to compensate for the lateral motion of the media.

6. The method of claim 5 wherein shifting the pel data further comprises:

determining the number of (n) pel positions to shift the pel data based on the lateral offset and a spacing between the nozzle positions of the ink jet print head.

7. The method of claim 6 wherein:

identifying the pel data in the buffer further comprises:

identifying a scan line of pel data in the buffer; and shifting the pel data in the buffer further comprises:

shifting the scan line the number of (n) pel positions to maintain a margin between the edge of the media and a printed area on the media.

8. A non-transitory computer readable medium embodying programmed instructions which, when executed by a processor, are operable for performing a method on a print controller of a printer, the method comprising:

identifying an edge of a media that is parallel to a direction of travel of the media;

determining a lateral offset between the edge of the media and a print head of the printer; and modifying data for the print head based on the lateral offset to compensate for a lateral motion of the media relative to the print head by:

identifying pel data in a buffer for an ink jet print head, wherein pel positions in the buffer correspond with nozzle positions of the ink jet print head; and shifting the pel data in the buffer a number of (n) pel positions based on the lateral offset to compensate for the lateral motion of the media.

9. The non-transitory computer readable medium of claim 8 wherein shifting the pel data further comprises:

determining the number of (n) pel positions to shift the pel data based on the lateral offset and a spacing between the nozzle positions of the ink jet print head.

10. The non-transitory computer readable medium of claim 8 wherein:

identifying the pel data in the buffer further comprises:

identifying a scan line of pel data in the buffer; and shifting the pel data in the buffer further comprises:

shifting the scan line the number of (n) pel positions to maintain a margin between the edge of the media and a printed area on the media.

11. A print controller of a printer, the print controller comprising:

a detection system operable to identify an edge of a media that is parallel to a direction of travel of the media, and to determine a lateral offset between the edge of the media and a print head of the printer; and a data compensator operable to determine a fractional number of pels to shift the data for the print head based on the lateral offset to compensate for a lateral motion of the media relative to the print head, to upscale the pel data to a higher resolution based on the fractional number of pels and a pel resolution of the print head, to shift the higher resolution pel data based on the fractional number of pels, and to downscale the higher resolution pel data to the pel resolution of the print head to compensate for the lateral motion of the media.

12. The print controller of claim 11 wherein:

the data compensator is further operable to downscale the higher resolution pel data to the resolution of the print head by averaging pels within a grid that corresponds with an original resolution of the pel data.

13. A non-transitory computer readable medium embodying programmed instructions which, when executed by a processor, are operable for performing a method on a print controller of a printer, the method comprising:

identifying an edge of a media that is parallel to a direction of travel of the media;

determining a lateral offset between the edge of the media and a print head of the printer; and modifying data for the print head based on the lateral offset to compensate for a lateral motion of the media relative to the print head by:

determining a fractional number of pels to shift pel data for the print head based on the lateral offset;

up-scaling the pel data to a higher resolution based on the fractional number of pels and a pel resolution of the print head;

shifting the higher resolution pel data based on the fractional number of pels; and downscaling the higher resolution pel data to the pel resolution of the print head to compensate for the lateral motion of the media.

14. The non-transitory computer readable medium of claim 13 wherein downscaling the higher resolution pel data further comprises:

averaging pels within a grid that corresponds with an original resolution of the pel data.

* * * * *